United States Patent [19]

Drahus

[11] Patent Number: 5,016,351

[45] Date of Patent: May 21, 1991

[54] DISPOSABLE SAFETY RAZOR SYSTEM

[76] Inventor: Denis P. Drahus, 6956 Cinnamon Loop, Columbus, Ga. 31909

[21] Appl. No.: 493,736

[22] Filed: Mar. 15, 1990

[51] Int. Cl.[5] ..... B26B 19/40; B26B 21/00; B26B 21/40

[52] U.S. Cl. ..... 30/41; 30/47; 30/90

[58] Field of Search ..... 30/41, 43, 86, 90, 47, 30/41, 47, 90; 222/131

[56] References Cited

U.S. PATENT DOCUMENTS 4,023,269 5/1977 Lopez, Jr. ..... 30/41
4,377,034 3/1983 Druash et al. ..... 30/41
4,512,077 4/1985 Tanabe et al. ..... 30/41
4,791,723 12/1988 Jacobson ..... 30/41
4,908,945 3/1990 Jacobson ..... 30/41

*Primary Examiner*—Douglas D. Watts
*Assistant Examiner*—Paul M. Heyrana, Sr.
*Attorney, Agent, or Firm*—James A. Hinkle

[57] ABSTRACT

A disposable safety razor system having a shaving head, a control head assembly and an integral pressurized foam canister. The control head assembly has an activator, which when depressed, allows foam shaving cream to be dispensed through a tube in the control head assembly to the user. A removable locking tab is provided which prevents the inadvertent dispensing of the foam until the user is ready to receive the foam.

3 Claims, 1 Drawing Sheet

DISPOSABLE SAFETY RAZOR SYSTEMcBACKGROUND OF THE INVENTION

I. Field of the Invention

The present invention relates generally to the field of toilet articles, and more particularly to that area relating to razors utilizing a system combining disposable cartridge blades and a unitary pressurized container of shaving cream.

II. Description of the Prior Art

Typically, a safety type razor and the necessary accouterments for shaving, such as a shaving foam or gel, requires considerable cumbersome bulk when utilized in the home.

It has been found that the traveling public has a need for an inexpensive, easily carried safety razor system which may be utilized for a very limited number of shaves and then disposed of conveniently. In today's era of wide spread travel, many travel related business such as hotels, transportation carriers and the like, provide giveaway toilet articles for their customers. Frequently these businesses provide soaps, shampoos, toothbrushes and other limited toilet articles. The present inventor has found that there is a need for a convenient, inexpensive shaving system that may be utilized not only as an item offered for sale to the traveling public, but may also be utilized as an advertising giveaway for certain travel related businesses.

There have been numerous patents in the prior art which describe various types of safety razor systems, generally employing a handle element which is hollow and filled with a shaving cream or gel. The contents were typically dispensed either by a manual operation of a plunger type pump or by the use of a pressurized gas from a container. For instance, the present inventor is the patentee of a "Safety Razor Kit", U.S. Pat. No. 4,377,034, which is descriptive of the prior art. By and large, however, the devices of the prior art proved somewhat limited due to their size, bulk and inefficient design when being utilized in their intended mode.

SUMMARY OF THE INVENTION

In accordance with the present invention, it is contemplated that a razor head is operatively connected to a control head assembly which is mounted atop a pressurized foam canister holding shaving cream or gel. The control head assembly contains a valve mechanism which, when depressed, will activate the canister dispensing nozzle thereby allowing free flow of the foam from the canister to the user of the razor until the valve is closed. A locking mechanism is provided to prevent the activating mechanism for the canister valve to be actuated until the locking tab is removed by the ultimate user.

An object of the invention is the provision of an easily manufactured, relatively inexpensive self-contained and disposable safety razor system which may be sold either at retail for limited use by the traveling public or may be used as a giveaway item by travel related businesses and others.

Other objects, advantages and capabilities of the invention will become apparent from the following description, taken in conjunction with the accompanying drawings, showing only a preferred embodiment of the invention.

DESCRIPTION OF THE PREFERRED EMBODIMENT

Figure 1:
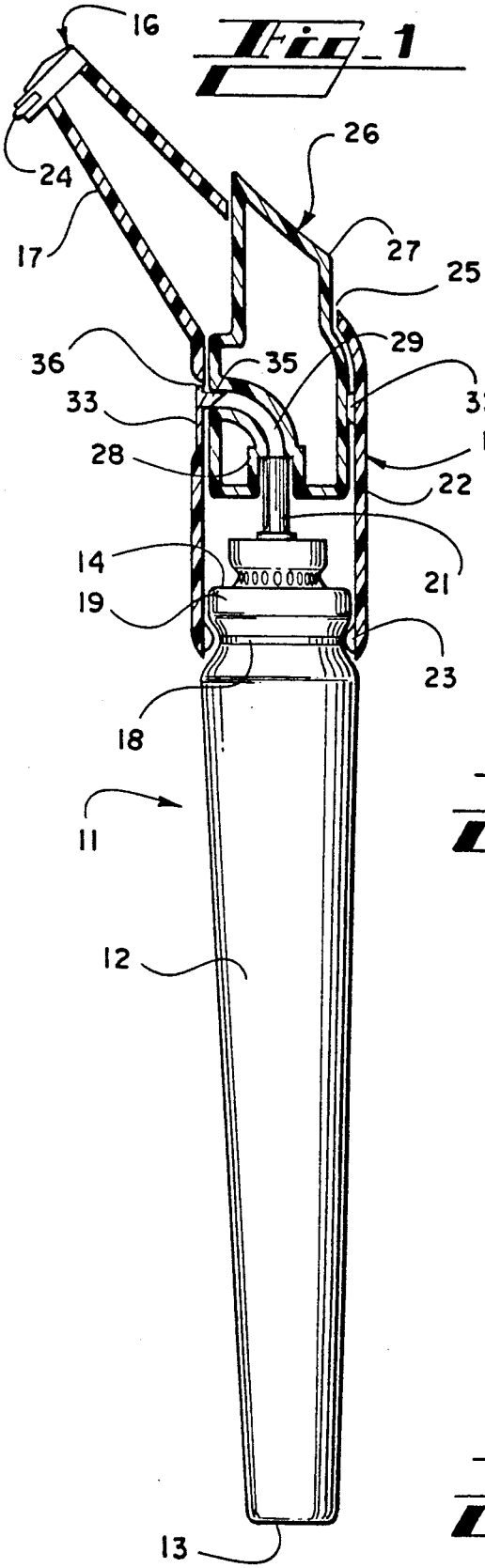
FIG. 1 is an elevation view of the present invention showing the control head assembly sectioned down its center line to show the innermost workings thereof.

Referring to the drawings wherein like numerals designate corresponding parts throughout the several figures, the safety razor system of the present invention is generally indicated by the numeral 11. The safety razor system generally includes a pressurized foam canister 12, having a distal end 13 and a proximal end 14. Attached to the proximal end 14 is a control head assembly 15 which supports the razor head 16 by a tubular support 17.

To overcome the difficulties of the prior art and to allow the ultimate user a convenient, well-formed ergonomic superior handle, the pressurized foam canister 12 is of a relatively small diameter and is tapered from the proximal end to the distal end to provide a convenient handle. Near the proximal end of the canister 12, the canister decreases in diameter and narrows to a tapered neck 18 and then flares out once again to a larger diameter indicated by shoulder 19. Atop the proximal end of the canister 12 is a canister dispensing nozzle 21, which is designed to reciprocate along the longitudinal center line of the canister to dispense the shaving cream, or gel, which is housed within the canister. When the dispensing nozzle 21 is in its most extended position, the canister is in a closed condition. When external pressure is applied to the dispensing nozzle along the longitudinal center line thereof, the nozzle then reciprocates into the canister causing a valve to open therein (not shown) allowing the shaving cream, or gel, to be dispensed.

The control head assembly 15 comprises a cylindrical outer sleeve 22, which houses the main components of the control head. At the distal end of the outer sleeve 22, the configuration is of an open container which is adapted to fit about the shoulder 19 of the canister 12 and to be maintained on the canister by means of a plurality of retaining nipples 23 which will frictionally engage the tapered neck 18, thereby retaining the entire control head assembly on the canister 12. It is anticipated that during manufacture the control head assembly 15 will be snapped on to the canister 12 and that the open distal end thereof will deform sufficiently to allow the placement of the head assembly in its intended manner. The proximal end of the control head assembly 15 includes the tubular support 17 which is angled, at a convenient shaving angle, to the longitudinal center line of the control head assembly and the center line of the canister. Mounted atop the tubular support 17 is the razor head 16, which would normally include a razor blade or series of razor blades 24. It is anticipated that any number of manufacturers might supply well-known types of razor heads 16 which would prove satisfactory to the present invention, and it is not believed that great detail needs to be disclosed herein.

Figure 3:
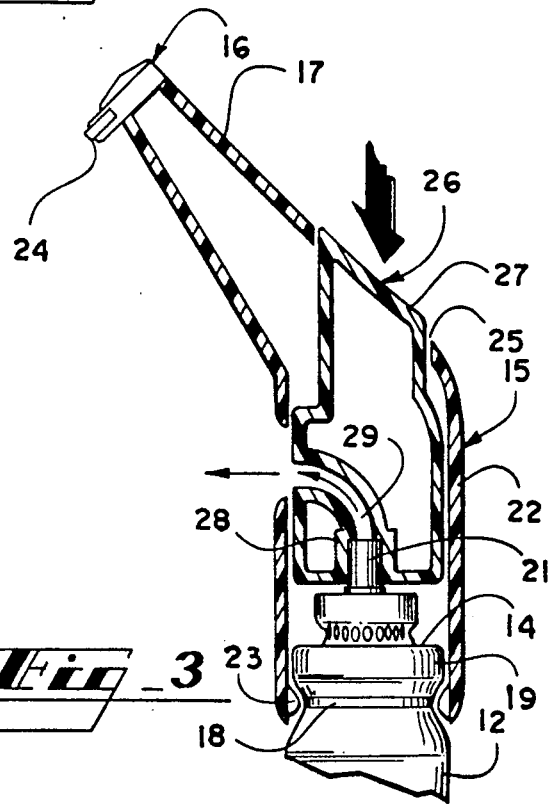
FIG. 3 is a partial elevation view showing the control head assembly in section view similar to that of FIG. 1, however, showing the activator locking tab removed and the activator button depressed to allow flow of the shaving cream from the canister.

Mounted within the control head assembly 15 and projecting through an aperture 25, within the tubular support 17, is an activator 26 which is generally of an elongated tubular configuration. One end of the activator 26 comprises and activator button 27, connected to the main shell of the activator 26, which then terminates in an activator control housing 28. As is especially seen in FIGS. 1 and 3, the activator control housing 28 overlies and encompasses the free end of the canister dispensing nozzle 21 and permits, upon the downward pressure thereof, the reciprocation of the dispensing nozzle 21 into the canister 12 which will then allow the shaving cream, with the canister, to be ejected therefrom into the activator dispensing port 29; and, ultimately, to the exterior of the safety razor system 11. As is evident, when the activator button 27 is depressed the activator control housing 28 will depress the dispensing port 29 in the upwardly and outwardly curved passage of the dispensing port 29. It is anticipated that the user would cup his hand near the termination of the dispensing port 29 to receive the dispensed foam. In this manner the foam is readily available for use and will not clog the otherwise sensitive portions of the razor, and prevent additional use thereof.

Figure 2:
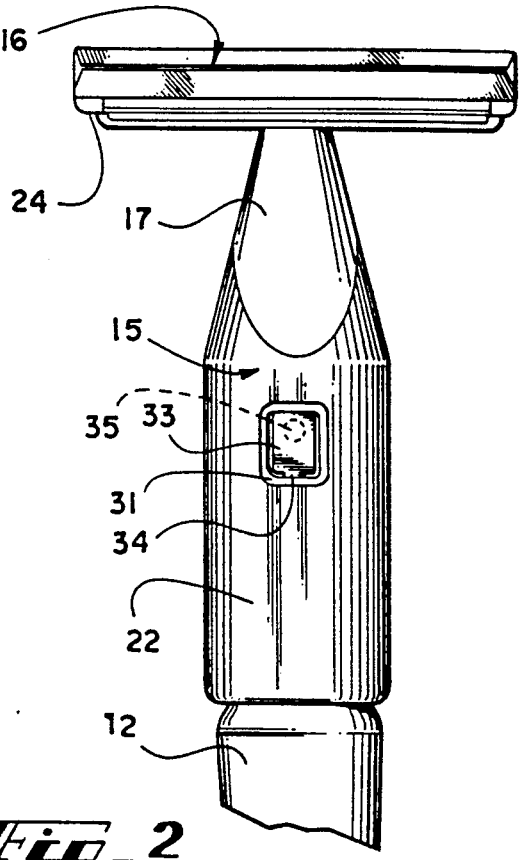
FIG. 2 is a partial elevation view showing the control head assembly of the invention and especially showing the activator locking tab prior to its removal for use.

As can be seen, it would be quite important that the dispensing port 29 align itself with the dispensing opening 31 of the control head assembly. The dispensing opening 31 is easily seen in FIG. 2 and generally comprises a somewhat rounded, rectangular opening to allow free exit of the shaving cream at the time of use. In order to maintain the alignment of the dispensing port 29 with the dispensing opening 31, it is anticipated that the internal walls of the outer sleeve 22 of the control head assembly would have multiple alignment nipples 32 projecting therefrom, and exterior walls of the activator 26. Such an alignment mechanism would maintain the activator 26 in its intended alignment and would allow reciprocation of the activator at the desired times. As is well known, pressurized foam nozzles, such as shown by nozzle 21, are normally biased in the closed extended position and will exert pressure upon the activator 26 after the user force is released from activator button 27 to return the activator 26 to its battery position.

During packaging, handling, shipment and shelf storage, there is a possibility that the activator button 27 might well be depressed either accidentally or on purpose, which action would be detrimental if not done by the ultimate user. It might well be that in a storage area the present invention might not be packaged in a tamper-proof package or even if it is packaged in a blister type package, there is the possibility that the activator button could be depressed thereby expelling the shaving foam from the canister. To prevent the foam from being expelled until the desired time, the present invention contemplates the addition of an activator locking tab 33 to prevent the movement of the activator 26 until the desired moment. The locking tab 3 generally comprises a planar body member of a size that would be somewhat smaller than the dispensing opening 31, and molded to the control head assembly at connecting point 34. Attached and molded into the tab 33, on its interior surface, is an activator locking knob 35 which is designed to mate with the dispensing port 29 and project thereinto a sufficient distance to maintain the activator in an open condition until the knob 35 is removed. As is evident, as long as the locking knob 35 rests within the dispensing port 29, normal pressure upon the activator button 27 will not cause the dispensing nozzle 21 to reciprocate into the canister 12. When it is desired to utilize the razor system, the ultimate user would place his fingernail, or a suitable object, into the upper portion of the dispensing opening 31 and grasp the free end 36 of the tab 33 and then bend it outwardly away from the control head assembly thereby breaking the tab from the control head assembly at the connecting point 34. Once this is accomplished the activator button 27 could be depressed thereby dispensing the foam from the pressurized canister.

Various modifications may be made of the invention without departing from the scope thereof and it is desired, therefore, that only such limitations shall be placed thereon as are imposed by the prior art and which are set forth in the appended claims.

What is claimed is:

1. A disposable safety razor system having a shaving head, a control head assembly and a pressurized foam canister, the foam canister having an elongated shape with a distal end and a proximal end, the proximal end of the canister having a tapered neck and a shoulder for mounting the control head assembly in operative position about the neck and shoulder, the proximal end of the canister further having a dispensing nozzle for reciprocation into the canister at predetermined times to dispense the contents of the canister, the control head assembly comprising a tubular outer sleeve having a lower end mounted upon the head and shoulder of the proximal end of the canister, and further having an upper end mounting the shaving head, the control head assembly further having a first aperture at the proximal end and a second aperture located in the sidewall of said assembly, activating means reciprocately positioned within the control head assembly, a portion of said activating means projecting through the aperture in the proximal end of the control head assemblY, the activating means having one end of a dispensing tube mounted in juxtaposition with the dispensing nozzle of the canister, the other end of the tube terminating adjacent the control head assembly sidewall aperture whereby when the activating means is moved against the dispensing nozzle an amount of foam is dispensed through the tube and out of the control head assembly sidewall aperture, locking means positioned in the control head assembly sidewall aperture to selectively prevent movement of said activating means.

2. The safety razor system as claimed in claim 1, wherein said locking means comprises a tab discretely attached to the control head assembly sidewall, and further having a locking knob projecting therefrom into the terminating end of the dispensing tube to prevent the inadvertent reciprocation of the activator.

3. The safety razor system as claimed in claim 2, wherein said tab is adapted to be separated from the control head assembly to remove the locking means from the dispensing tube thereby allowing reciprocation of the activator upon command.

* * * * *